US012246370B2

(12) United States Patent
Schaprian

(10) Patent No.: US 12,246,370 B2
(45) Date of Patent: Mar. 11, 2025

(54) STRETCH ROLLING DEVICE AND STRETCH ROLLING METHOD

(71) Applicant: SMS GROUP GMBH, Duesseldorf (DE)

(72) Inventor: Markus Schaprian, Duesseldorf (DE)

(73) Assignee: SMS GROUP GMBH, Duesseldorf (DE)

( * ) Notice: Subject to any disclaimer, the term of this patent is extended or adjusted under 35 U.S.C. 154(b) by 0 days.

(21) Appl. No.: 17/641,609

(22) PCT Filed: Sep. 10, 2020

(86) PCT No.: PCT/EP2020/075271

§ 371 (c)(1),
(2) Date: Mar. 9, 2022

(87) PCT Pub. No.: WO2021/048246

PCT Pub. Date: Mar. 18, 2021

(65) Prior Publication Data

US 2022/0362827 A1 Nov. 17, 2022

(30) Foreign Application Priority Data

Sep. 11, 2019 (DE) ..... 102019213833.0

(51) Int. Cl.
*B21D 5/08* (2006.01)
*B21H 1/20* (2006.01)
(Continued)

(52) U.S. Cl.
CPC ..... *B21D 5/08* (2013.01); *B21H 1/20* (2013.01); *B21H 1/22* (2013.01); *B21K 27/04* (2013.01)

(58) Field of Classification Search
CPC ... B21H 1/20; B21H 1/22; B21H 9/00; B21K 27/04; B21B 39/04; B21B 39/06;
(Continued)

(56) References Cited

U.S. PATENT DOCUMENTS 9,138,802 B2 * 9/2015 Murata ..... B21K 27/04

FOREIGN PATENT DOCUMENTS

CN 102430678 A 5/2012
CN 202539243 U 11/2012
(Continued)

OTHER PUBLICATIONS

International Search Report, dated Dec. 23, 2020 in corresponding International Application No. PCT/EP2020/075271.

*Primary Examiner* — Jared O Brown
(74) *Attorney, Agent, or Firm* — Amster, Rothstein & Ebenstein LLP

(57) ABSTRACT

A stretch-rolling device and a stretch-rolling method for pressure-forming workpieces by rolls. The stretch-rolling device includes a pair of work-rolls with two rolls, which can each be rotated about their roll axes and form a roll gap between them. The rolls implement a plurality of stages in an axial direction, which are set up for stepwise deformation of the workpieces as the workpieces pass through the stages successively. A manipulator with a plurality of gripping devices, which are arranged on a working side of the pair of work-rolls, are set up to grip the workpieces at an assigned stage to guide the workpieces through the roll gap in a feed/retraction direction. A support is arranged to temporarily support the workpieces in cooperation with the manipulator to transfer the workpieces to another gripping device, which is preferably an adjacent gripping device of the next higher stage.

19 Claims, 4 Drawing Sheets

(51) Int. Cl.
*B21H 1/22* (2006.01)
*B21K 27/04* (2006.01)

(58) Field of Classification Search
CPC .. B21B 39/20; B21B 39/24; B21J 5/00; B21J 9/02; B21J 9/022; B21J 13/10; B21J 13/12; B21D 1/05
See application file for complete search history.

(56) References Cited

FOREIGN PATENT DOCUMENTS

| | | | | | |
|---|---|---|---|---|---|
| DE | 1269087 | B | | 5/1968 | |
| DE | 1269087 | B4 | | 5/1968 | |
| DE | 102014101150 | A1 | * | 7/2015 | ..... B21H 1/20 |
| DE | 102014101151 | A1 | | 7/2015 | |
| DE | 102016112946 | A1 | * | 1/2018 | ..... B21H 1/20 |
| EP | 2316589 | A1 | | 5/2011 | |
| GB | 791659 | A | * | 5/1958 | |
| JP | 5253576 | A | | 10/1975 | |
| JP | H1157921 | A | * | 3/1999 | |
| WO | WO-2016207016 | A1 | * | 12/2016 | ..... B21H 1/22 |
| WO | 2018/171828 | A1 | | 9/2018 | |

* cited by examiner

STRETCH ROLLING DEVICE AND STRETCH ROLLING METHOD

CROSS REFERENCE TO RELATED APPLICATIONS

This application is a national phase of PCT application No. PCT/EP2020/075271 filed Sep. 10, 2020, which claims priority to DE patent application No. 102019213833.0, filed Sep. 11, 2019, all of which are incorporated herein by reference thereto.

TECHNICAL FIELD

The invention relates to a stretch-rolling device and a stretch-rolling method for pressure-forming workpieces by rolling. For this purpose, the stretch-rolling device has a pair of work rolls with two rolls, which implement a plurality of stages in the axial direction, and which are configured for the stepwise deformation of the workpieces, in that the workpieces successively pass through the stages.

BACKGROUND OF THE INVENTION

The stretch rolling process is a type of longitudinal rolling process in which the rolling stock is transported through the roll gap perpendicularly to the rolling axes and thereby deformed. The stretch rolling process is characterized by the fact that a blank to be rolled, for example a round or square material, is fed to the rolls by a manipulator and is formed in individual stages, which are arranged in the axial direction of the rolls and are also referred to as "passes", "calibers" or "sectors". The stages of the rolls therefore usually have different rolling profiles and the blank to be rolled passes through one after the other, resulting in a stepwise change of the profile cross-section of the blank.

Stretch rolling is particularly suitable for the production of intermediate forms, such as semi-finished products or preforms, and in rarer cases also of finished parts. In the production of intermediate shapes, stretch rolling allows simplifying downstream processing steps such as drop forging. For example, the use of materials and the process forces in drop forging can be reduced and the surface quality of the components can be increased. Specifically, stretch rolling is used, for example, to produce intermediate forms for components such as crankshafts, axles and link components.

DE 10 2014 101 150 A1 describes a stretch-rolling device which has a roll pair with two rolls whose direction of rotation can be reversed and two gripping devices for handling the workpieces to be rolled. The two gripping devices are arranged on opposite sides of the roll pair. Furthermore, the rolls have at least two rolling tools, i.e., stages, in the axial direction, the stages being configured for the stepwise forming of the workpiece.

According to the technology described in DE 10 2014 101 150 A1, the output of the workpieces is limited in that the handling of the workpieces by the two gripping devices always only takes up part of the pair of rolls, i.e., not all stages are used at the same time.

An increase in output is achieved with a stretch rolling device according to DE 10 2016 112 946 A1. For this purpose, a plurality of gripping devices are installed on the opposite sides of the pair of rolls, wherein two opposing gripping devices, which form a pair of gripping devices, are assigned to one step and grip the corresponding workpiece. In addition, the stretch-rolling device has a transfer device for transporting the workpieces from one pair of gripping devices to another pair of gripping devices in the working cycle of the device.

The increase in output according to DE 10 2016 112 946 A1 comes at the expense of a considerable construction effort, since two gripping devices are used per stage for parallel occupation of the stages in order to grip the workpiece at both ends. In addition, the parallel rolling of a plurality of workpieces is associated with a technical problem resulting from the fact that the workpieces have different lengths due to the deformation at different stages along the axial direction of the rolls. For this purpose, length compensation between the individual gripping devices must be ensured in order to ensure a reliable and high-quality rolling process.

SUMMARY OF THE INVENTION

It is an object of the invention is to provide an improved stretch-rolling device and an improved stretch-rolling method, in particular to realize a high output of workpieces with reduced structural complexity.

The object is achieved with a stretch rolling device and a stretch rolling method as recited in the claims set forth below. Advantageous developments follow from the dependent claims, the following description of the invention and the description of preferred embodiments.

The stretch-rolling device according to the invention is used for the pressure forming of workpieces, preferably metallic workpieces, by rolling.

The stretch-rolling device has a pair of work rolls with two rolls, which can each be rotated about their roll axes and form a roll gap between them. The rolls are configured to realize several stages in the axial direction, for the stepwise deforming the workpieces, by the workpieces successively passing through the stages. When deforming the workpieces, the work rolls rotate in opposite directions. The direction of rotation of the work rolls can be reversed. However, this is not strictly required. Normally, the rolled profiles differ at the different stages to achieve a gradual deformation of the workpieces. Preferably, each workpiece passes through all stages, from the lowest stage to the highest stage. However, in special cases it may also be possible that not all stages act on the workpieces, i.e., stages are omitted or skipped. The terms "successive", "stepwise" etc. do not necessarily limit the processing to a complete run through of all available stages.

The stretch-rolling device also has a manipulator, preferably precisely one manipulator with a plurality of gripping devices. Preferably, the number of gripping devices is equal to the number of stages. The gripping devices, preferably the entire or substantially entire manipulator, are arranged on a working side of the pair of work rolls and are adapted to grip the workpieces and guide them through the roll gap at an associated stage in a feed/retraction direction. The working side is defined by the position of the pair of working rolls and the gripping devices. The side opposite the working side (relative to the pair of working rolls) can be designed as a tool changing side, via which maintenance work, such as a roll change, can be carried out.

The stretch rolling apparatus further comprises a support arranged to temporarily support workpieces and transfer them in cooperation with the manipulator to another gripping device, preferably the adjacent gripping device of the next higher stage. In other words, the workpieces are transferred from one gripping device to another gripping device, preferably a gripping device of a higher stage, for example the next higher stage. This transfer of the workpieces normally takes place once per work cycle of the stretch rolling device. The workpiece that has completed processing, preferably the workpiece of the highest level, is ejected. Furthermore, a new workpiece, which is also referred to herein as a blank, is fed to the lowest processing stage. Thus, when the workpieces are handed over, normally only the first workpiece (the blank) to the penultimate workpiece are gripped and picked up by a gripping device. It should be noted that the term "finished part" refers only to the stretch rolling process, i.e., it does not necessarily indicate an end product or finished part. Rather, the finished workpiece that has passed through all the intended stages of the stretch rolling device is preferably an intermediate form, such as a semi-finished product or preform.

The support is not a manipulator because the support does not have gripping devices configured to grip the workpieces and feed them through the roll gap in a feed/retraction direction. In particular, the support does not have any gripping devices that enter or pass or are capable of passing through the roll gap. The support can be configured passive in that the workpieces are placed thereon for transfer or the support supports the workpieces without actively gripping or clamping them. Alternatively, the support can have retaining means configured to temporarily retain or stabilize, for example to grip or clamp, the workpieces.

The thusly constructed stretch-rolling device allows several workpieces to be processed at the same time by a parallel occupation of all or at least several stages, for example every second stage. The parallel occupation allows increasing the output of the workpieces, and thus productivity. This is achieved without installing two or more manipulators on opposite sides of the pair of work rolls. If necessary, the manipulator only has to include further gripping devices, such as tongs, on the working side, which achieves the improved functionality without a significant increase in the structural and procedural complexity of the stretch rolling device. The transfer of the workpieces to gripping devices during the process in subsequent stages is realized in connection with a support. This achieves a high output with a comparatively small number of assemblies, which also improves the reliability and maintainability of the stretch rolling device.

Preferably, one or more gripping devices are designed to be rotatable about their own axis to enable the corresponding workpieces to be rotated between the individual stages. This means a rotation of the workpieces about their longitudinal axis by a certain angle, for example 90°. The rotation can take place before or after the deforming at the respective stage.

Preferably, the gripping devices are configured to grip the workpieces at one end and feed them through the roll gap at an assigned stage, while the workpieces are not gripped at the other end. Gripping of the "second" end of the workpiece by an additional gripping device of a manipulator is not required, which not only reduces the structural complexity but also the process control.

Preferably, the support can be moved in the axial direction and/or in the feed/retraction direction. In particular, the movability of the support can be used to implement or at least support the transfer of the workpieces by transporting the workpieces transversely by the support. As an alternative or in addition, the support can be configured so that it can be moved in the up/down direction, for example to descend during rolling and not to impede the rolling process.

The support is preferably arranged on the working side. Thus, the support does not obstruct or limit access to the side opposite the working side, which is advantageously designed as a tool changing side. This improves the maintainability of the stretch rolling device.

Preferably, the number of gripping devices is equal to the number of stages, the assignment of gripping device to the stage being a one-to-one correspondence. In this way, the pair of work rolls can be optimally used along the axial direction, with the configuration and control of the individual gripping devices being able to be designed in the best possible way for the associated stage.

Preferably, the gripping devices can be moved by the manipulator in the axial direction and/or the feed/retraction direction, with the manipulator itself being particularly preferably moveable for this purpose in the axial direction and/or the feed/retraction direction relative to the pair of work rolls. In particular, the movability of the gripping devices or the manipulator can be used to realize the transverse transport, i.e., transport of the workpieces for transfer in the axial direction, either in connection with a stationary support or in combination with a support that can also be moved.

At the end of the rolling process, the workpieces of the different stages usually have different lengths. In order to compensate for these different lengths, at least one gripping device can preferably be adjusted relative to the manipulator in the feed/retraction direction. This can be realized by means of a length compensation section, which can adjust the gripping device, such as the clamps, of the corresponding gripping device for length compensation in the feed/retraction direction. Preferably, at least N−1 (where N denotes the number of stages) gripping devices have such a length compensation section. The increase in length and/or the rate of increase in length may vary from stage to stage. Thus, the gripping devices are preferably individually movable. For this purpose, the individual mobility or movability in the feed/retraction direction can be implemented passively, for example spring-loaded, or actively, for example pneumatically, by an electric motor, etc.

Preferably, the support has holding means configured to temporarily hold, preferably clamp the workpieces for transfer to the respective adjacent gripping device of the next higher stage, while the gripping devices grip. In this way, the reliability of the handover can be improved. In this case, the holding means are preferably essentially stationary relative to the support, i.e., apart for example from a clamping movement.

The object is also achieved by a stretch-rolling method for pressure-forming workpieces using a stretch-rolling device according to the above description. The method includes: gripping a plurality of workpieces by a respective gripping device of the manipulator; passing the workpieces through the roll gap formed by the pair of work rolls at an associated stage in the feed/retraction direction; rotating the rolls, preferably in opposite directions, and applying pressure to the workpieces through the rolls, thereby deforming the workpieces according to their stage; transporting the workpieces to a transfer position and supporting the workpieces by the support, preferably placing the workpieces onto the support; releasing the workpieces from the gripping devices; and gripping the workpieces by another gripping device, preferably the adjacent gripping device of the next higher stage.

The features, technical effects, advantages and exemplary embodiments that have been described in relation to the stretch-rolling device apply analogously to the stretch-rolling method.

One or more workpieces are thus preferably rotated between the individual stages about their longitudinal axes, for example by 90°. The rotation can take place before or after the forming at the respective stage.

Furthermore, it is particularly preferred that the gripping devices of the manipulator grip the workpieces at one end and guide them through the roll gap at the assigned stage, while the workpieces are not gripped at the other end.

In order to transfer the workpieces to another gripping device, the support preferably moves in the axial direction and/or in the feed/retraction direction and/or up/down in order to effect or at least support the transfer. Alternatively, or additionally, the gripping devices are moved by the manipulator in the axial direction and/or in the feed/retraction direction to transfer the workpieces to another gripping device. For this purpose, it is particularly preferred that essentially only the manipulator itself moves relative to the pair of work rolls in the axial direction and/or in the feed/retraction direction.

In order to compensate for different lengths of the workpieces at the various stages, at least one gripping device is preferably adjusted relative to the manipulator in the feed/retraction direction according to the length of the associated workpiece. Preferably, the gripping devices are moved individually during rolling, since the increase in length and/or the rate of increase in length can vary from stage to stage. This can be done passively, for example with a spring, or actively, for example pneumatically, with an electric motor, etc.

The number of workpieces to be rolled is preferably smaller than the number of stages available, for example approximately half as large. A reduced occupancy of the stages may be favorable or necessary to comply with machine limits with regard to force or energy consumption.

Further advantages and features of the present invention are evident from the following description of preferred embodiments. The features described there can be implemented individually or in combination with one or more of the features described above, insofar as the features are not inconsistent with one another. The following description of the preferred embodiments is made with reference to the accompanying drawings.

DETAILED DESCRIPTION OF PREFERRED EMBODIMENTS

In the following, preferred embodiments are described with reference to the Figures. Same, similar or functionally equivalent elements are provided with the same reference symbols in the Figures, and a repeated description of these elements is in some instances dispensed with to avoid redundancies.

Figure 1A:
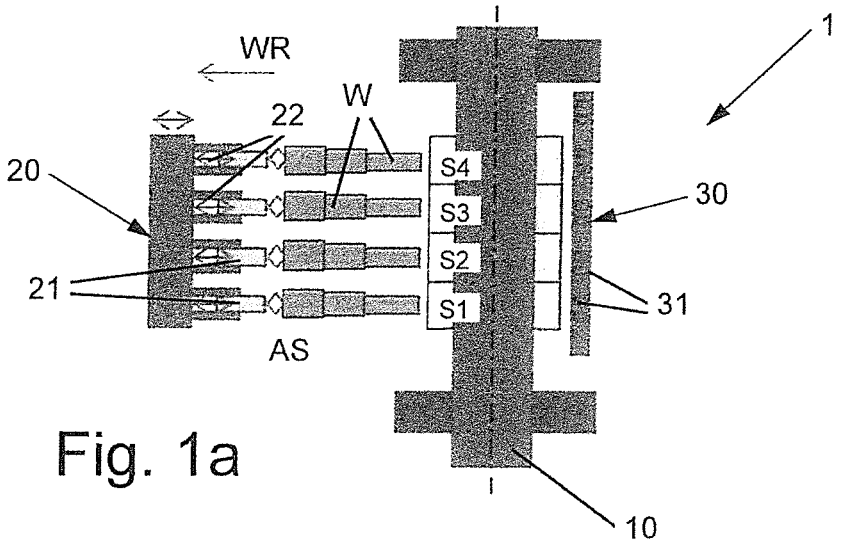
FIGS. 1*a* to 1*c* are schematic top views of a stretch-rolling device in different process stages according to one embodiment.
Figure 1B:
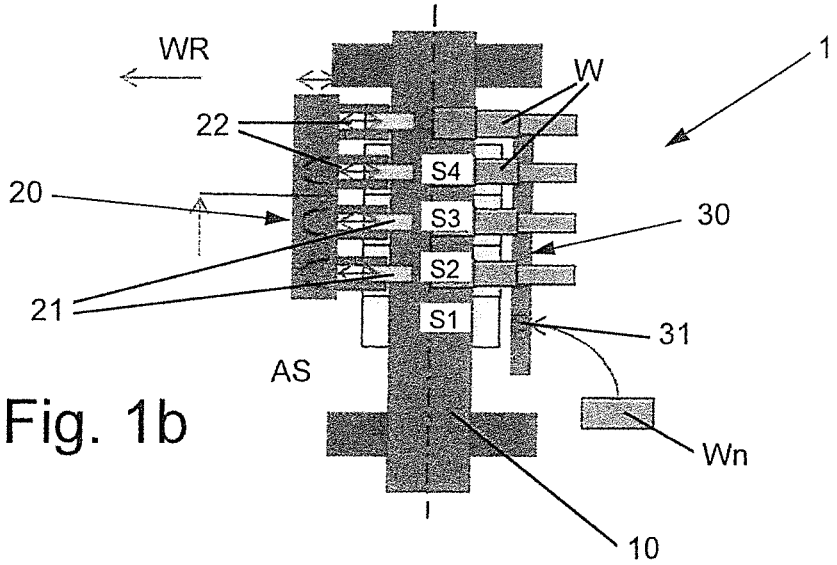
Figure 1C:
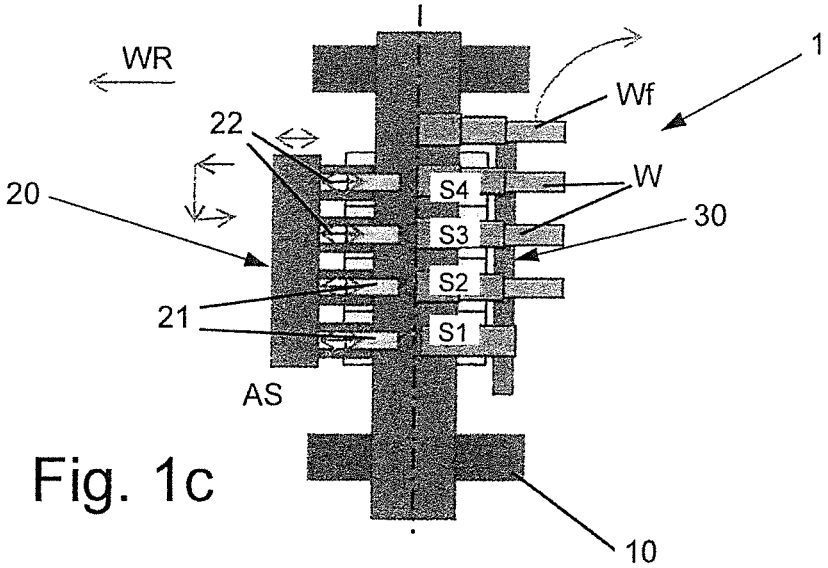

FIGS. 1*a* to 1*c* are schematic plan views of a stretch rolling device 1 in different process stages according to an embodiment. The stretch rolling device 1 is configured for press-forming workpieces W by rolling.

First, the components of the stretch-rolling device 1 will be explained and then a stretch-rolling method that can be carried out with these components.

The stretch rolling device 1 has a pair of work rolls with a top and a bottom roll 10. The top roll is omitted from the figures for better visibility of the manipulation and transport of the workpieces W. The rolls 10 are rotatable in opposite directions. Their direction of rotation can be reversible, but this is not strictly required. In the axial direction, the rolls 10 include a plurality of stages S1 to S4, which are also referred to as passes, calibers or segments. Preferably, the rolling profile of the work rolls differs at the different stages S1 to S4. The stages S1 to S4 are used for the stepwise deforming of the workpieces W, wherein for this purpose such a workpiece W passes through the stages S1 to S4 successively. Four stages S1 to S4 are shown as examples in the Figures.

Between the stages S1 to S4, the workpieces W are preferably rotated by an angle, for example 90°, as indicated by arrows in FIG. 1*b*. The rotation can take place before or after the forming at the respective stage S1 to S4.

The stretch-rolling device 1 also has a manipulator 20 with a plurality of gripping devices 21. The gripping devices 21 are assigned according to the stages S1 to S4, wherein a one-to-one correspondence is not necessarily required. For example, a gripping device 21 can be configured to serve several stages. However, the number of gripping devices 21 is preferably equal to the number of stages S1 to S4 as shown in the Figures, in which case the correspondence is one-to-one. The side on which the manipulator 20 with the gripping devices 21 is located relative to the pair of work rolls is referred to herein as the working side AS. The gripping devices 21 have adjustable clamping jaws, for example, in order to be able to securely grip the workpieces W and release them for transfer.

According to the embodiment of FIGS. 1*a* to 1*c*, the manipulator 20 is configured movable in the axial direction of the rolls 10 (referred to herein as "axial direction" or "transverse direction") and in the horizontal radial direction of the rolls 10 (referred to herein as "radial direction" or "feed/retraction direction"), as indicated by arrows in the Figures. However, alternatively or additionally, one or more of the degrees of freedom can also be realized individually by the gripping devices 21. Individual mobility of the gripping devices 21 or part of the gripping devices 21 (preferably at least three out of four) in the feed/retraction direction, also represented by arrows in the figures, is particularly preferably provided in order to realize a length compensation function to compensate for a change in the length of the workpiece W caused by the different stages S1 to S4. For this purpose, the individual movability in the feed/retraction direction can be implemented passively, for example with a spring, or actively, for example pneumatically, with an electric motor, etc. In addition, the gripping devices 21 can be configured to be rotatable about their own axis to enable the workpieces W to be rotated between the individual stages S1 to S4.

The stretch-rolling device 1 also has a support 30 which, according to the embodiment of FIGS. 1*a* to 1*c*, is arranged on the side opposite the working side AS. The support 30 can be configured stationary or movable along one or more degrees of freedom. The support 30 can be configured passive, so that the workpieces W are placed thereon in a feed position (FIG. 1*b*, described in detail below) or the support 30 supports the workpieces W without actively gripping or clamping them. Alternatively, the support 30 can have retaining means 31 configured to temporarily retain, for example to grip or clamp, the workpieces W.

Since the support 30 and/or the manipulator 20 or its gripping devices 21 are designed to be movable in the axial direction, a separate transfer device for transferring the workpieces W to adjacent gripping devices 21 is not required.

FIGS. 1*a* to 1*c* show the stretch-rolling device 1 in positions of different process stages.

The stretch-rolling device 1 according to FIG. 1*a* is in a retracted position in which all workpieces W being processed, held by the corresponding gripping devices 21, are completely withdrawn or retracted from the roll gap formed by the pair of work rolls.

Then the manipulator 20 moves the workpieces W into the fully advanced position, shown in FIG. 1*b*. The gripping devices 21 enter the roll gap and, if necessary, pass through the roll gap with their front ends. Preferably, no rolling, i.e., no plastic deformation of the workpieces W by the rolls 10, takes place during this transfer. Instead, the transfer serves to align the workpieces W, with positioning on the support 30 and, if necessary, with rotation of one or more of the workpieces W about their own axes, preferably 90°. The transfer to the fully advanced position has an axial component, i.e., the workpieces are shifted transversely to the higher stage S2 to S4 (upwards in the Figures), resulting in no workpiece W on the first stage S1 at the end of the transfer.

During or after the transfer to the fully advanced position, a new workpiece/blank Wn is fed to the first stage S1 by a feeder (not shown in the figures) by positioning it on the corresponding position of the support 30. The feeding of a new workpiece Wn is shown in FIG. 1*b* by an arrow. The feeder can be implemented, for example, by a robot which takes the workpiece Wn from a storage container, furnace or the like (also not shown in the figures) and places it on the support 30 at stage S1. The feeder can be part of the stretch rolling device or a separate component.

After the transfer into the completely advanced position, the finished workpiece Wf, which has completely passed through the rolling process, is also gripped by a discharge device (not shown in the figures) and discharged or removed from the process. This method step is shown in FIG. 1*c*, with the delivery of the finished workpiece Wf being represented by an arrow. The discharge device can be implemented, for example, by a robot that grips the workpiece Wf and transfers it to a subsequent device, for example a transport device or a storage container. The discharge device can be part of the stretch rolling device or a separate component. The removal of the finished workpiece Wf by the discharge device and the supply of a new workpiece Wn by the feeder may occur simultaneously, substantially simultaneously, or sequentially.

With the workpieces W held in the fully advanced position by the support 30, the gripping devices 21 can release their associated workpieces W, and the manipulator 20 drives the gripping devices 21 substantially axially toward the first stage S1 (downward in the Figures) where the first gripping device 21 grips the newly supplied workpiece Wn and the other gripping devices 21 grip the adjacent workpiece W of the preceding stage S2 to S4, respectively. The transfer of the workpieces W can be seen from a comparison of FIGS. 1*b* and 1*c*.

After the finished workpiece Wf has been discharged and all workpieces W, including the new workpiece/blank Wn, have been gripped by the gripping devices 21—this process stage can be regarded as the start of a work cycle—the workpieces W are rolled. For this purpose, the workpieces W are gripped by the roll profiles of the corresponding stages S1 to S4 of the rolls 10, transported by rotating the rolls 10 (in the direction of rotation opposite to the transfer into the advanced position) and plastically deformed. The direction of rolling (to the left in the Figures) is denoted herein by the reference symbol WR. The stretch-rolling device then returns to the position shown in FIG. 1*a*. Various operating modes are possible for carrying out a work cycle. For example, the rolls 10 can be driven continuously at a constant or variable speed. Alternatively, the rolls 10 may be operated in a start/stop mode, such as by means of a direct drive and/or using a clutch and/or brake.

Figure 2A:
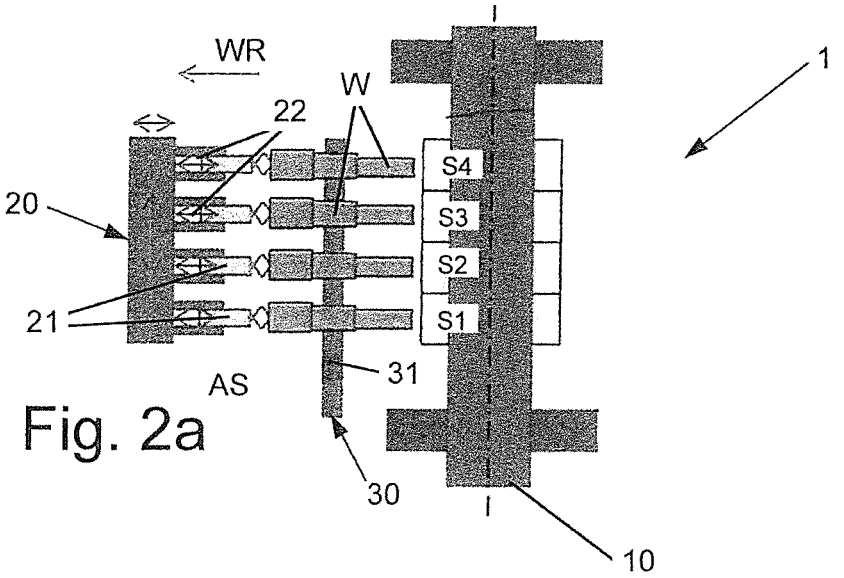
FIGS. 2*a* to 2*c* are schematic top views of a stretch-rolling device in different process stages according to a further embodiment.
Figure 2B:
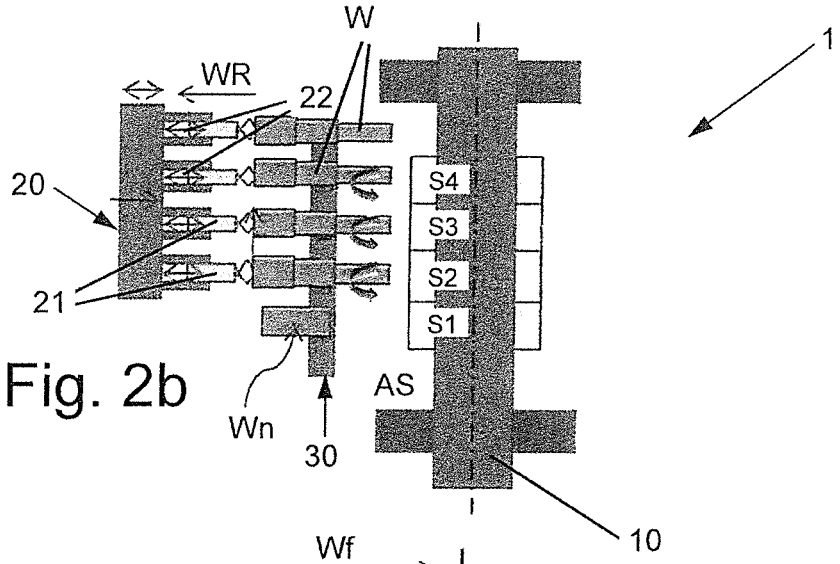
Figure 2C:
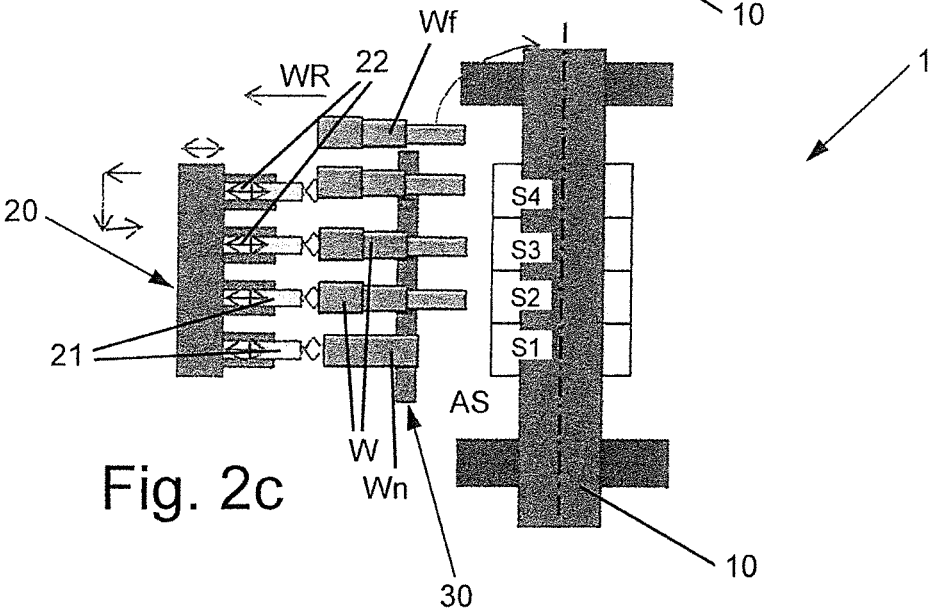

FIGS. 2*a* to 2*c* are schematic plan views of a stretch-rolling device 1 in different stages of the process according to a further embodiment. Since the structure and the process sequences largely correspond to those of the embodiment in FIGS. 1*a* to 1*c*, essentially only the differences are explained below. This applies equally to the embodiment of FIGS. 3*a* to 3*c* and the embodiment of FIGS. 4*a* to 4*c*.

The stretch-rolling device according to FIGS. 2*a* to 2*c* differs from the previous embodiment essentially in that the support 30 is arranged on the working side AS. The support 30 can also be configured passive, so that the workpieces W are placed on the support or the support 30 supports the workpieces W without actively gripping or clamping them. Alternatively, the support 30 can have retaining means 31 configured to temporarily retain, for example to grip or clamp, the workpieces W. According to this embodiment, the workpieces W are supplied and discharged on the working side AS, as can be seen from FIGS. 2*b* and 2*c*. In order to support the transfer of the workpieces W to adjacent gripping devices 21, the support 30 can be configured so as to be movable in the axial direction. Movability in the feed/retraction direction and/or up/down direction (=direction perpendicular to the axial direction and feed/retraction direction) can also be implemented, for example to support or to prevent hinderance of transfer of the workpieces W through the roll gap.

In addition to the technical effects that apply to all of the embodiments presented herein and are described below, an advantage of the present embodiment of FIGS. 2*a* to 2*c* is that the support 30 does not obstruct or limit access to the side opposite the working side AS, which is advantageously designed as a tool changing side. Thus, the stretch rolling device can be maintained more easily and quickly.

The two embodiments of FIGS. 1*a* to 1*c* and 2*a* to 2*c* transfer the workpieces W to the next higher stage S2 to S4 essentially by moving the manipulator 20 and/or its gripping devices 21 in the axial direction. The following two embodiments of FIGS. 3*a* to 3*c* and 4*a* to 4*c* realize the repositioning of the workpieces W essentially by moving the support 30 in the axial direction.

For this purpose, the support 30 is designed to be movable at least in the axial direction. It can be configured passive, so that the workpieces W are placed on it or the support 30 supports the workpieces W without actively gripping or clamping them. Alternatively, the support 30 can have retaining means 31 which are set up to temporarily retain, for example to grip or clamp, the workpieces W.

Figure 3A:
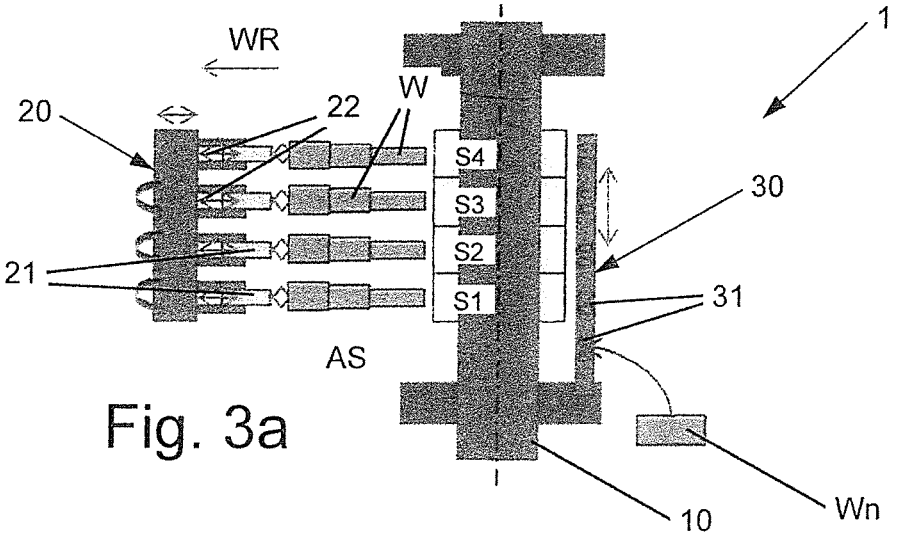
FIGS. 3*a* to 3*c* are schematic plan views of a stretch-rolling device in different process stages according to a further embodiment.
Figure 3B:
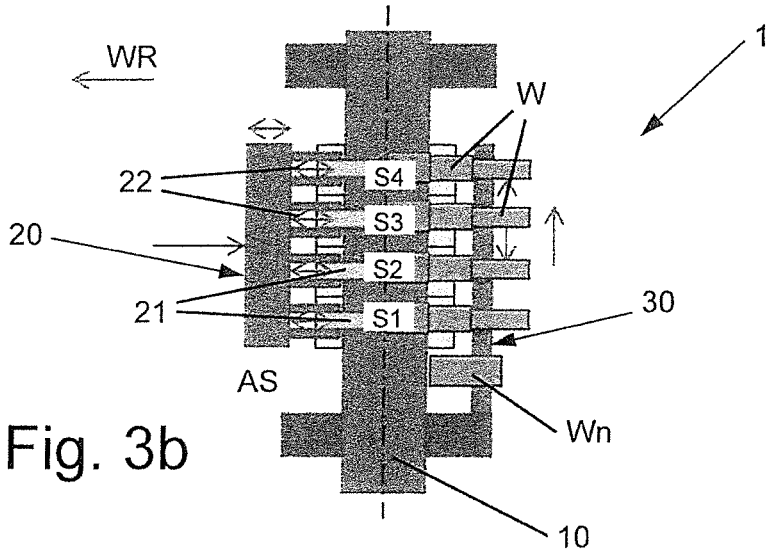
Figure 3C:
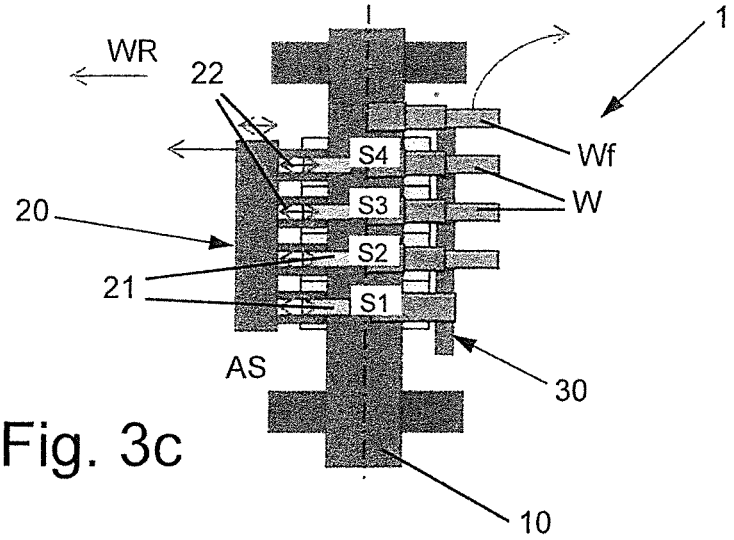
Figure 4A:
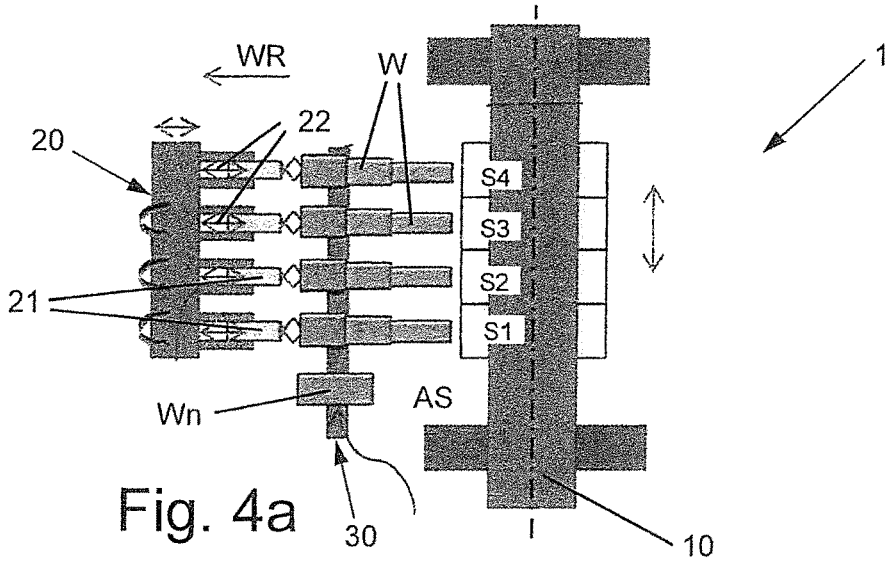
FIGS. 4*a* to 4*c* are schematic top views of a stretch-rolling device in different process stages according to a further embodiment.
Figure 4B:
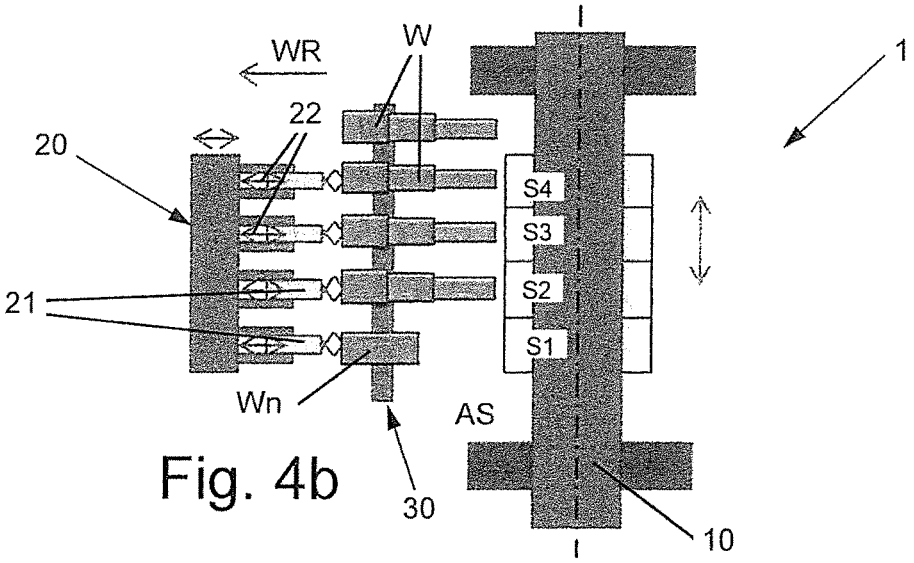

The support 30 can be installed on the working side AS as shown in FIGS. 3*a* to 3*c*. Alternatively, the support can be arranged on the side opposite the working side AS, as can be seen from FIGS. 4*a* and 4*b*.

Figure 4C:
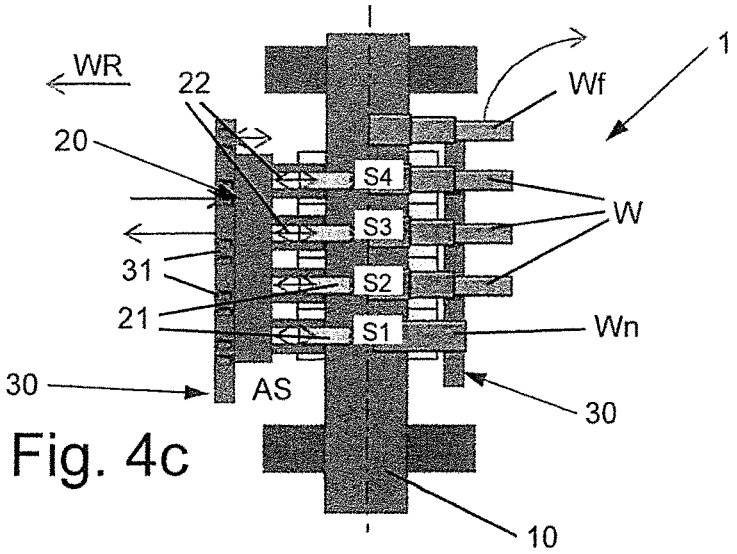

The tray 30 can alternatively or additionally be configured to be movable in the feed/retraction direction between the two sides, i.e., the working side AS and the side opposite to the working side AS. Furthermore, several supports 30 can be provided, as can be seen in FIG. 4*c*, for example, if this improves or simplifies the handling of the workpieces W, or in order to be able to implement different process sequences with one and the same stretch rolling device 1 without significant reconfiguration.

At the end of the rolling process, the workpieces W of stages S1 to S4 usually have slightly different lengths. In order to compensate for these differences in length, at least some, preferably at least N−1 (here N designates the number of stages), gripping devices 21 have a length-compensating section 22. The length compensation sections 22 can be implemented, for example, by a spring system that can deflect to different extents for the length compensation of the gripping devices 21.

In the herein described embodiments, the workpieces W are rolled on the "return" i.e., the transfer from the advanced position to the starting position of FIGS. 1*a*, 2*a*, 3*a* and 4*a*. However, alternatively or additionally, plastic deformation of the workpieces by the rolls 10 can also take place during forward transfer, i.e., during transfer into the advanced position.

The herein described stretch-rolling concept allows simultaneous occupation of all or at least several stages S1 to S4, for example every second stage. A reduced occupation of stages S1 to S4 may be necessary to comply with machine limits with regard to force or energy consumption. Nevertheless, the stretch-rolling device 1 enables the output of the workpieces W to be optimized due to the parallel configuration. This is achieved without the need for two manipulators on opposite sides of the pair of work rolls. The manipulator on the working side AS is only expanded by further gripping devices 21, such as tongs, which achieves the improved functionality without a significant increase in the structural and procedural complexity. The transverse transport, i.e., transport of the workpieces W in the axial direction, is implemented, for example, either by an additional transverse transport axis in the manipulator 20 in conjunction with a stationary support 30 or by combining a manipulator 20 that is stationary in the axial direction with a support 30 that can be moved in the axial direction. In this case, it is not necessary for the "second" end of the workpieces W to be gripped by another manipulator. In this way, a high output is achieved with a comparatively small number of assemblies, which also improves the reliability and maintainability of the stretch rolling device.

As far as applicable, all individual features that are presented in the embodiments can be combined with one another and/or exchanged without departing from the scope of the invention.

LIST OF REFERENCE SIGNS

1 stretch-rolling device
10 roll
20 manipulator
21 gripping device
22 length compensation section
30 support
31 restraining means
S1-S4 stage
W workpiece
Wn new workpiece/blank
WF finished workpiece
AS working side
WR rolling direction

The invention claimed is:

1. A stretch rolling device for providing a press-forming operation of workpieces by rolling, the stretch rolling device comprising:

a pair of work-rolls, each rotatable about a roll axis and forming a roll gap between the pair of work rolls for receiving the workpieces, the pair of work-rolls having a plurality of stages in an axial direction, the plurality of stages being configured for a stepwise and contemporaneous deformation of the workpieces as the workpieces pass through the plurality of stages successively a feed/retraction direction which is normal to the roll axis of each of the pair of work-rolls, wherein the pair of work-rolls demarcate a working side of the stretch rolling device and a side opposite of the working side of the stretch rolling device;

a manipulator having a plurality of gripping devices which is arranged only at and defines the working side of the pair of work-rolls and, wherein the side opposite of the working side of the stretch rolling device is without any manipulator and/or one or more gripping devices, each of the plurality of gripping devices being configured to grip the workpieces at only one end of the workpieces at an assigned one of the plurality of stages to guide the workpieces from the working side through the roll gap in the feed/retraction direction, wherein an opposing end of the workpieces on the side opposite the working side are not gripped by the plurality of gripping devices nor by any other manipulator with one or more gripping devices at the side opposite the working side of the stretch rolling device during a workpiece transferring operation and/or the press-forming operation, wherein the plurality of gripping devices of the manipulator are configured to extend and retract from the working side and enter or pass through the roll gap between the pair of work-rolls during the press-forming operation of the workpieces; and a support configured to temporarily support the workpieces and, in cooperation with the manipulator, to transfer the workpieces to another one of the plurality of gripping devices, wherein the support is arranged on the side opposite of the working side as viewed in a rolling direction.

2. The stretch rolling device according to claim 1, wherein one or more of the plurality of gripping devices are configured to be rotatable, for rotating corresponding ones of the workpieces about longitudinal axes of the corresponding ones of the workpieces.

3. The stretch rolling device according to claim 1, wherein the support is movable in the axial direction and/or in the feed/retraction direction and/or an up/down direction.

4. The stretch rolling device according to claim 3, wherein the manipulator is stationary.

5. The stretch rolling device according to claim 1, wherein a number of gripping devices of the plurality of gripping devices is equal to a corresponding number of the plurality of stages, wherein each gripping device is assigned to a respective one of the plurality of stages in one-to-one correspondence.

6. The stretch rolling device according to claim 1, wherein the plurality of gripping devices are movable by the manipulator in the axial direction and/or in the feed/retraction direction.

7. The stretch rolling device according to claim 1, wherein one or more of the plurality of gripping devices are individually movable relative to the manipulator in the feed/retraction direction in order to compensate for different lengths of the workpieces at one or more of the plurality of stages.

8. The stretch rolling device according to claim 7, wherein the one or more of the plurality of gripping devices are passively movable.

9. The stretch rolling device according to claim 7, wherein one or more of the plurality of gripping devices are actively moved pneumatically or by an electric motor.

10. The stretch rolling device according to claim 1, wherein the support includes a workpiece retainer configured to temporarily retain the workpieces for transfer of each workpiece to an adjacent gripping device of the plurality of gripping devices corresponding to a subsequent one of the plurality of stages.

11. The stretch rolling device according to claim 1, wherein the support is configured to temporarily support the workpieces and, in cooperation with the manipulator, to transfer the workpieces to an adjacent one of the plurality of gripping devices of a subsequent one of the plurality of stages.

12. The stretch rolling device according to claim 1, wherein the manipulator is movable relative to the pair of work-rolls in the axial direction and/or in the feed/retraction direction, and wherein the support is stationary.

13. A stretch rolling method for pressure forming workpieces by the stretch rolling device according to claim 1, the stretch rolling method comprising:

gripping a plurality of workpieces by respective ones of the plurality of gripping devices of the manipulator on the working side of the stretch rolling device;

passing the workpieces through the roll gap formed by the pair of work-rolls at respective ones of the plurality of stages in the feed/retraction direction:

rotating the pair of work-rolls and applying pressure to the workpieces by the pair of work-rolls, thereby contemporaneously deforming the workpieces according to the respective ones of the plurality of stages;

transporting the workpieces to a transfer position and supporting the workpieces by the support;

releasing the workpieces from the plurality of gripping devices; and gripping the workpieces at a subsequent one of the plurality of stages by another one of the plurality of gripping devices;

wherein the plurality of gripping devices grip the workpieces at the one end of the workpieces and extend and guide the workpieces from the working side through the roll gap while the workpieces are not gripped at the opposing end of the workpieces at the side opposite the working side of the stretch rolling device during transferring, rotating, transporting and/or press-forming operations.

14. The stretch rolling method according to claim 13 further comprising a step of rotating one or more of the workpieces about longitudinal axes of the workpieces while positioned between at least two of the plurality of stages.

15. The stretch rolling method according to claim 13 further comprising a step of moving the support in the axial direction and/or the feed/retraction direction and/or an up/down direction during a transfer of the workpieces to another one of the plurality of gripping devices.

16. The stretch rolling method according to claim 13, wherein during a transfer of the workpieces to another one of the plurality of gripping devices, the stretch rolling method further comprises a step of moving the plurality of gripping devices by the manipulator in the axial direction and/or the feed/retraction direction, and moving the manipulator relative to the pair of work-rolls in the axial direction and/or in the feed/retraction direction.

17. The stretch rolling method according to claim 13 further comprising a step of moving at least one of the plurality of gripping devices individually relative to the manipulator in the feed/retraction direction according to a length of an associated workpiece.

18. The stretch rolling method according to claim 17, wherein the step of moving the at least one of the plurality of gripping devices comprises passively moving the at least one of the plurality of gripping devices.

19. The stretch rolling method according to claim 17, wherein the step of moving the at least one of the plurality of gripping devices comprises actively moving the at least one of the plurality of gripping devices pneumatically or by an electric motor.

* * * * *